United States Patent [19]

Förnäs et al.

[11] Patent Number: 4,539,027

[45] Date of Patent: Sep. 3, 1985

[54] DUST BAG FOR USE IN A VACUUM CLEANER

[75] Inventors: Mikael Förnäs; Raimo Sipilä ; Altti Lehto, all of Rauma, Finland

[73] Assignee: Raupak Oy, Rauma, Finland

[21] Appl. No.: 535,589

[22] Filed: Sep. 26, 1983

[30] Foreign Application Priority Data

Sep. 29, 1982 [FI] Finland ..... 823339

[51] Int. Cl.[3] ..... B01D 46/02

[52] U.S. Cl. ..... 55/378; 55/381; 55/DIG. 2; 383/13

[58] Field of Search ..... 55/374, 378, 381, DIG. 2; 15/347, DIG. 8; 383/13, 24, 29, 34; 493/264

[56] References Cited

U.S. PATENT DOCUMENTS

| | | | |
|---|---|---|---|
| 2,975,863 | 3/1961 | Sosnowich | 55/381 |
| 3,803,815 | 4/1974 | Anderson et al. | 55/DIG. 2 |
| 4,044,421 | 8/1977 | Kristenson et al. | 55/DIG. 2 |

*Primary Examiner*—David L. Lacey

*Attorney, Agent, or Firm*—Kuhn Muller and Bazerman

[57] ABSTRACT

A general purpose dust bag for a vacuum cleaner adaptable to various vacuum cleaners. According to the invention, the external surface of the dust bag's end (4) adjacent to its mouth (2) is provided with an attachment device (7), such as a strip of paper 24 glued to the dust bag, the external surface of said strip 24 having thereon a permanent adhesive for securing a desired cassette plate to said bag.

4 Claims, 2 Drawing Figures

DUST BAG FOR USE IN A VACUUM CLEANER

The present invention relates to a dust bag for use in a vacuum cleaner, said dust bag comprising an actual bag portion and a mouth, with the bag portion made of an air permeable material, said bag being insertable in the vacuum chamber of a vacuum cleaner, with the end of said bag portion facing the mouth fitted pressure-tightly against the coupling of a dust tube inserted in the vacuum chamber, said mouth communicating with the dust tube.

Such dust bags are generally employed in nearly all vacuum cleaners. The present day dust bags, so-called dust bag cassettes are essentially provided with a special cassette plate, mounted in a substantially fixed position on the end facing the mouth of a dust bag around said mouth and fit to be inserted in a vacuum cleaner substantially pressure-tightly against the coupling of a dust tube inserted in said vacuum cleaner for fixing the dust bag pressure-tightly to a vacuum cleaner. The basic dust bag designs intended for various makes of vacuum cleaners do not generally differ from each other. However, different manufacturers use different cassette plates fixed to dust bags, so that in a given vacuum cleaner make it is only possible to use a dust bag and its cassette plate intended by the manufacturer of that particular vacuum cleaner. This way the vacuum cleaner manufacturers try to ensure that, after purchasing a vacuum cleaner, a consumer will have to use in the future just the dust bags manufactured and sold by this manufacturer. From the point of view of a vacuum cleaner manufacturer this is naturally quite advantageous, as that manufacturer in thus quite free to determine the price of dust bags. On the other hand, this situation is unfavourable from the point of view of a consumer as he is forced to pay a relatively high price for his dust bag.

An object of the present invention is to eliminate the above drawbacks. A particular object of the invention is to provide a dust bag which is adaptable for use in substantially all different types of vacuum cleaners.

As for the characterizing features of the invention, reference is made to the annexed claims.

The invention is based on a dust bag fitted with a special fixing means, such as a permanent adhesive, e.g. a sticker adhesive for fixing a separate cassette plate to said dust bag. The cassette plate can be removed e.g. from a used dust bag made by the manufacturer of said vacuum cleaner and dust bag. Thus, a consumer will be able to buy and use general purpose dust bags without having to buy just those dust bags made by a particular vacuum cleaner manufacturer for a particular vacuum cleaner.

Figure 1:
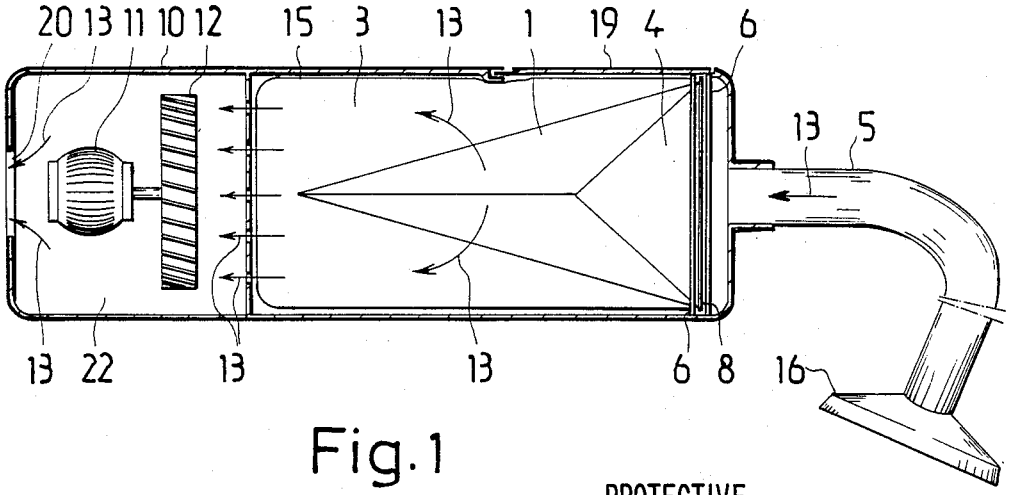
Figure 2:
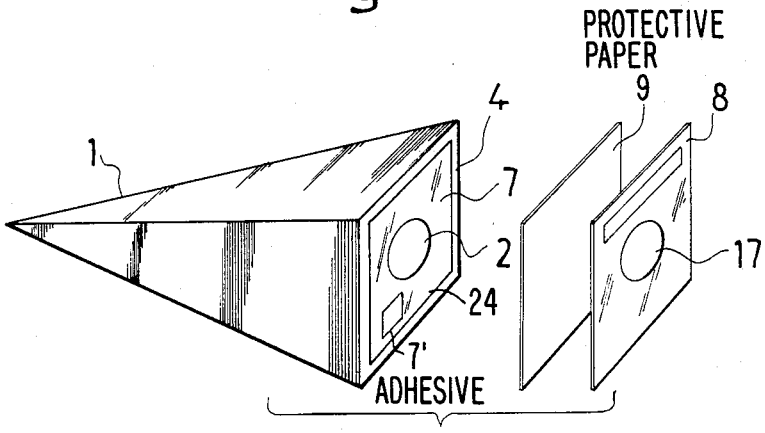

The invention will now be described in detail by explaining one embodiment thereof with reference made to the accompanying drawing, in which:

FIG. 1 is a partially cut-away side view of a vacuum cleaner fitted with a dust bag of the invention, and FIG. 2 shows a dust bag for the vacuum cleaner of FIG. 1 obliquely from above when fixing a cassette plate to said dust bag.

Referring to FIG. 1, first explained is the basic operation of a vacuum cleaner and dust bag. A vacuum cleaner 10 shown in FIG. 1 comprises a vacuum chamber 3 confined by walls; a dust tube 5 leading to said vacuum chamber; a blower 12 with its motor 11 arranged to discharge air from the vacuum chamber through an outlet 20; as well as a dust bag 1, installed in the vacuum chamber with the end 4 adjacent to the bag portion's mouth fitted pressure-tightly against a coupling 6 of the dust tube leading to said vacuum chamber, said mouth 2 communicating with the dust tube. The vacuum cleaner shown in FIG. 1 further comprises a partition 15 made of a fabric material, such as an air-permeable cloth between vacuum chamber 3 and blower 12. When operating the apparatus, blower 12 creates discharge of air from the vacuum cleaner through outlet 20, i.e. it generates vacuum or negative pressure in said vacuum chamber 3 which is in pressure communication with said blower. Thus, air streams through the vacuum cleaner from a nozzle 16 into dust tube 12, further on into dust bag 1, through the walls of said dust bag into vacuum chamber and further through fabric 15 into a positively pressured blower space 22 and out of the vacuum cleaner through outlet 20 in the direction of arrows 13.

The vacuum cleaner shown in FIG. 1 is provided with a dust bag 1 of the invention, shown in more detail in FIG. 2. The actual bag portion 1 of said dust bag is made of an air-permeable material, such as porous paper material. The bag end 4 adjacent to its mouth 2 is substantially like a plane and fitted with attachment means 7, such as a permanent adhesive 7' on the exterior surface of the bag adjacent its mouth for securing a desired cassette plate 8 to the dust bag. As shown in FIG. 2, the cassette plate is pressed against permanent adhesive 7' applied on the dust bag's end adjacent to its mouth 2, so that the cassette plate adheres pressure-tightly to the dust bag, the mouth 17 of the cassette plate and the mouth 2 of the bag opposite to each other. Thereafter, the dust bag with its cassette plate is fitted according to FIG. 1 in the vacuum chamber 3 of a vacuum cleaner 10 by way of a pressure-tight cover by fitting cassette plate 8 pressure-tightly in a manner known as such in a groove between the rails making up a coupling 6 between dust tube 5 and said bag. Hence, a dust bag of the invention is adaptable to any vacuum cleaner at all by fixing a cassette plate intended for that particular vacuum cleaner to the dust bag end adjacent to its mouth 2.

In the above embodiment, the external surface of the dust bag end adjacent to its mouth 2 is provided with an adhesive material 7' such as a permanent adhesive. In the principal embodiment of the invention, said attachment means 7 comprises a strip of paper 24 adapted to be secured to said end of the dust bag adjacent to its mouth 2, the external surface of said strip 24 being applied with a permanent adhesive 7' for attachment to a cassette plate. Furthermore, said permanent adhesive 7' can be covered e.g. with protective paper 9, which is removed when attaching a cassette plate to said dust bag.

The invention is not intended to be limited by the above examples but the embodiments of the invention can be varied within the scope of the annexed claims, as is self-evident for a person skilled in the art.

We claim:

1. A dust bag for use in a vacuum cleaner, said dust bag comprising an actual bag portion (1) and a mouth (2), said bag portion being made of an air-permeable material, the bag being installable in the vacuum chamber (3) of a vacuum cleaner with the bag portion's end (4) adjacent to said mouth fitted pressure-tightly against a coupling (6) of a dust tube (5) leading to said vacuum chamber, the mouth in communication with said dust tube, wherein the external surface of the dust bag's end (4) adjacent to its mouth (2) is provided with attachment means comprising an adhesive on a portion of the external surface thereof for securing said end of the dust bag to a desired cassette plate (8), for installing the dust bag in a desired vacuum cleaner; and wherein said adhesive is overlaid with a protective paper positioned and arranged so as to be removed from the surface thereof, said paper being removed from said adhesive by the user prior to securing said dust bag end to the cassette plate.

2. A dust bag according to claim 1, wherein said external surface of the dust bag adjacent its mouth is defined by a strip of paper glued to the end of the dust bag, the external surface of said strip being applied with said adhesive.

3. A disposable dust container universally adapted to fit vacuum cleaners of the type having a vacuum chamber, an inlet to said chamber for dust-laden air, a cassette plate adapted to fit around said inlet and having an aperture for the passage of the dust-laden air, and a dust container positioned in said chamber in adjoining relation to said cassette plate and in communication with said aperture; said dust container comprising a bag of substantially dust-tight but air-permeable material adapted to be disposed within said vacuum cleaner, said bag having an opening therein for the passage of the dust-laden air into said bag; and means for attaching said bag to a cassette plate having an aperture for the passage of air; said attaching means comprising at least a sheet of material covering the opening in said bag which has an aperture corresponding to an aperture in a cassette plate, said sheet of material having a permanent adhesive on the external surface thereof for attaching and securing said bag to said cassette plate.

4. A disposable dust bag as claimed in claim 3 in which the sheet of material having the adhesive thereon is covered with a sheet of protective paper positioned and arranged so as to be removed from the surface of the adhesive and which is removed prior to the bag being attached to a cassette plate.

* * * * *